United States Patent [19]

Hall

[11] 4,308,982

[45] Jan. 5, 1982

[54] SKI EQUIPMENT CARRIER

[76] Inventor: Scarlette J. Hall, Rte. 5, Box 407-A9, Stillwater, Okla. 74074

[21] Appl. No.: 124,260

[22] Filed: Feb. 25, 1980

[51] Int. Cl.[3] ..... A45C 11/38

[52] U.S. Cl. ..... 224/202; 224/917; 224/250; 224/205

[58] Field of Search ..... 224/202, 214, 250, 257, 224/265, 45 S, 917, 205; 280/814, 815

[56] References Cited

U.S. PATENT DOCUMENTS

| | | | |
|---|---|---|---|
| 1,816,510 | 7/1931 | Anderson | 224/250 X |
| 2,118,875 | 5/1938 | Windheim | 224/917 X |
| 2,224,568 | 12/1940 | Altorfer | 224/917 X |
| 3,368,655 | 2/1968 | Purdy | 224/45 S X |
| 3,504,405 | 4/1970 | Elliott-Smith | 224/45 S X |
| 4,002,349 | 1/1977 | Dopp | 280/814 |

*Primary Examiner*—Steven M. Pollard
*Attorney, Agent, or Firm*—Head & Johnson

[57] ABSTRACT

An apparatus for carrying elongated equipment, such as snow skis and poles, being comprised of a planar member having a plurality of opposed poles therethrough from a first end to a second end of said member; a plurality of strap means extending through said holes and around said elongated equipment to secure said equipment to said member; and a sling means attached to said member so as to enable said apparatus to be carried by an individual in an over-the-shoulder position. A plurality of yieldable clip means are attached to said member for securing said poles to said member in parallel position to said skis and the strap means and sling means being adjustable.

2 Claims, 3 Drawing Figures

SKI EQUIPMENT CARRIER

BACKGROUND OF THE INVENTION

1. Field of the Invention

The present invention relates to a ski equipment carrier and, more particularly, to such a carrier which is lightweight, and which is adapted to be carried in an over-the-shoulder position.

2. Description of the Prior Art

When an individual goes snow skiing, he or she generally has to carry the skis and poles across the top of a shoulder or carried in an underarm position. As can be seen, this takes one or both hands and can be uncomfortable even after a short distance of travel. Various ski equipment carriers have been developed in the past which are provided with complex clip and clamp mechanisms to secure the ski poles and skis to the carrier. Also, these Prior Art carriers generally are overly large and heavy so as to enable the individual to carry the heavy ski boots in addition.

None of these Prior Art devices provides a lightweight, simple ski equipment carrier which may be easily and comfortably carried by the skier in an over-the-shoulder position.

SUMMARY OF THE INVENTION

The present invention generally provides a ski equipment carrier which can transport snow skis and poles by simple attachment to the carrier. Further, the ski equipment carrier is designed to be carried in an over-the-shoulder position for comfort and freedom of movement.

The present invention, more particularly, comprises a planar member having a plurality of opposed holes therethrough from a first end to a second end of the member. A plurality of straps extend through the holes and around the member to attach the ski poles and skis to the member. A sling is attached to the member at a first and second end thereof so as to enable the carrier to be carried by an individual in an over-the-shoulder position. A plurality of yieldable clips or clamps are attached to the member and are adapted to secure the poles to the member in a parallel position to the skis. The straps and the sling are provided with buckles to provide adjustment thereof.

DETAILED DESCRIPTION OF THE PREFERRED EMBODIMENTS

Figure 1:
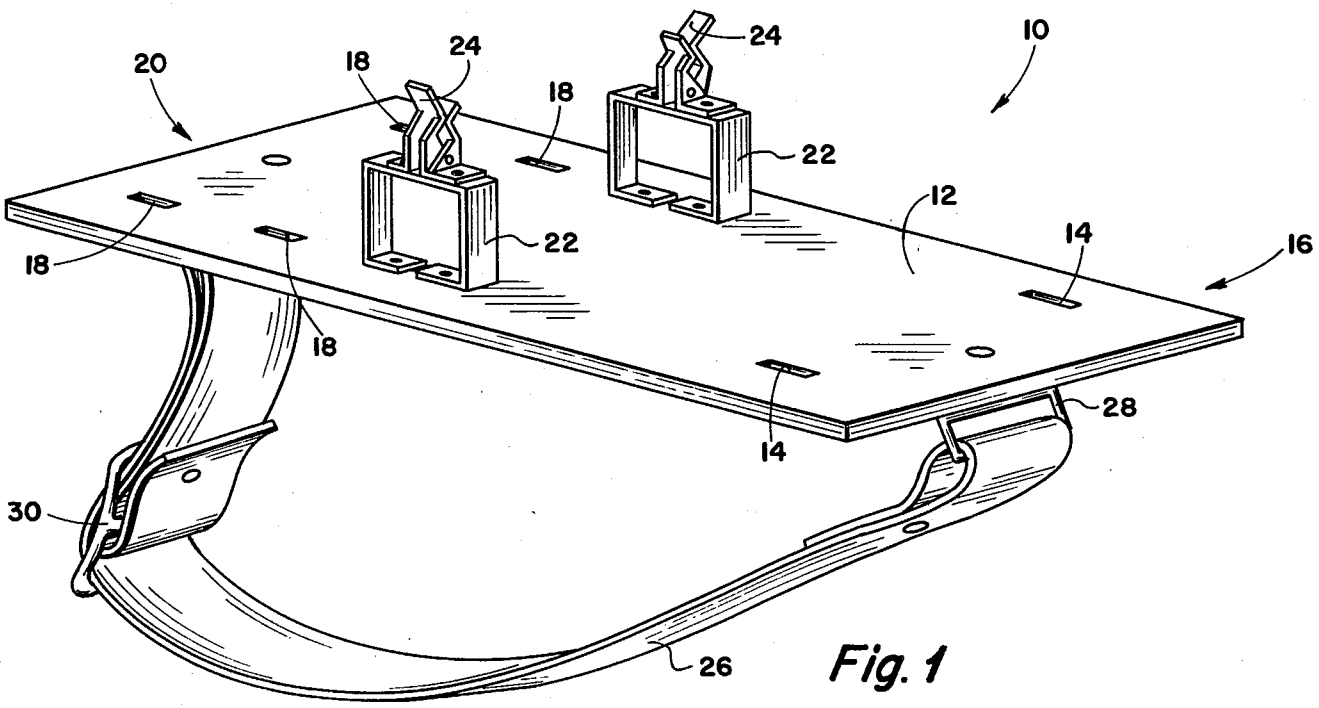
FIG. 1 is a perspective view of a ski equipment carrier embodying the present invention.

Referring to the drawings in detail, reference character 10 generally indicates a ski equipment carrier adapted to be carried by an individual in an over-the-shoulder position. As shown in FIG. 1, the ski equipment carrier 10 has a rectangular planar member 12 which is constructed of plexiglass, fiberglass, wood or other similar material. The member 12 provided with a pair of opposed parallel slots 14 adjacent a first end 16 thereof and two pair of opposed, parallel and in line slots 18 adjacent a second end 20 of the member 12. The slots 14 and 18 are parallel and in line to each other and adjacent the left and right edges of the member 12.

A pair of metal rectangular braces 22 are attached to the member 12 adjacent the left and right edges thereof and are parallel to the slots 14 and 18. Yieldable clip means 24 are attached to the upper portion of the braces or brackets 22.

A sling 26, which is constructed of canvas or leather, is attached to the member 12 by means of a pair of swivel mounted brackets 28, which are attached to the member 12 adjacent the first end 16 and the second end 20 thereof. The sling 26 is provided with a buckle 30 which allows for the adjustment in the length of the sling 26.

Figure 2:
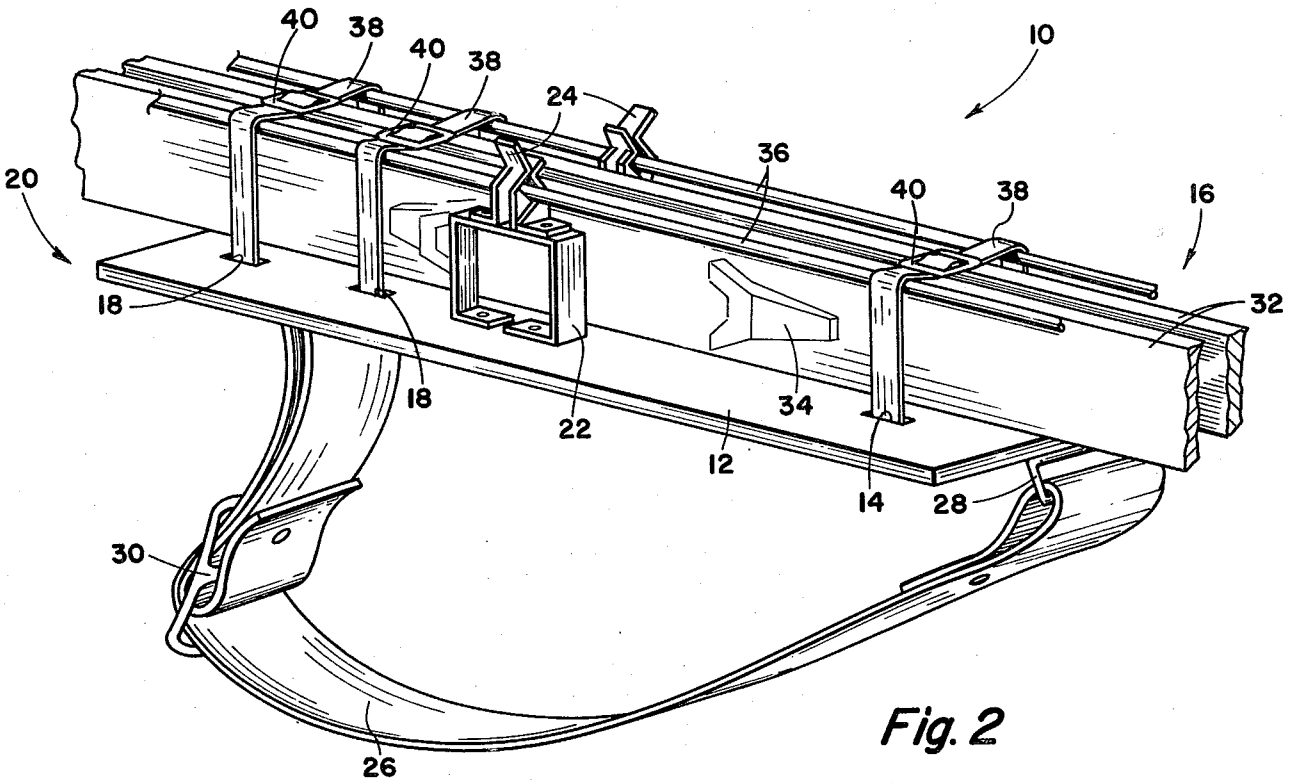
FIG. 2 is a perspective view of the ski equipment carrier with snow skis and poles attached thereto.
Figure 3:
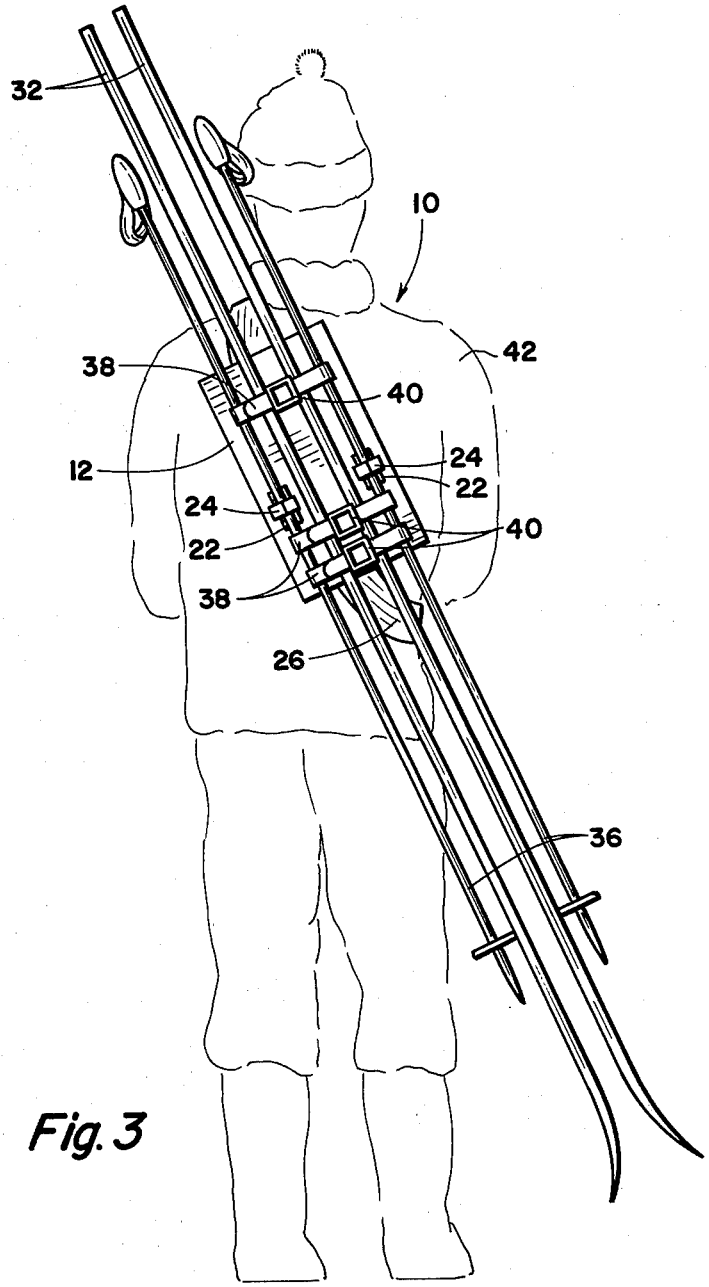
FIG. 3 is a rear elevational view of the ski equipment carrier with poles and skis attached thereto being carried by an individual.

As shown in FIG. 2, a pair of snow skis 32 with bindings 34 are placed together on edge, with the bindings 34 facing outwards between and in parallel with the slots 14 and 18. A pair of ski poles 36 are pressed into the yieldable clip means 24 and are secured thereto in parallel position to the skis 32. A plurality of straps 38 extend through the slots 14 and 18 underneath the member 12 and out the opposed adjacent slots 14 and 18 and around the skis 32 and poles 36. The straps 38 are provided with buckles 40 so as to enable the straps 38 to be drawn closely around the skis 32 and poles 36.

When the ski equipment carrier 10 is to be transported by an individual 42, the strap 26 is loosened and is placed over the head and shoulder of the individual 42 so as to be carried in an over-the-shoulder position. As can be seen, the ski equipment carrier 10 provides a simple and efficient transportation means for ski equipment which can be carried over a long distance with minimal fatigue to the individual 42 and frees the hands for other activities.

Whereas the present invention has been described in particular relation to the drawings attached hereto, it should be understood that other and further modifications of the invention, apart from those shown or suggested herein, may be made within the scope and spirit of this invention.

What is claimed is:

1. An apparatus for carrying elongated equipment, such as, snow skis and poles, at a diagonal angle across the back of an individual being comprised of:

a planar member one side of which will rest against said individual's back, said member having a plurality of parallel pairs of holes therethrough said planar member;

strap and buckle means extending through each pair of said holes and around said elongated equipment to secure said equipment to the other side of said planar member; and a single adjustable sling means attached to said planar member so as to enable said planar member to be carried over one shoulder of said individual at said diagonal angle.

2. An apparatus as in claim 1 including a plurality of yieldable clip means being attached to said member to secure said poles to said member.

* * * * *